United States Patent [19]

Wilson

[11] 4,415,134

[45] Nov. 15, 1983

[54] HALL EFFECT TRACK CIRCUIT RECEIVING ELEMENT

[75] Inventor: H. James Wilson, La Grange, Ky.

[73] Assignee: Safetran Systems Corporation, Louisville, Ky.

[21] Appl. No.: 344,618

[22] Filed: Feb. 1, 1982

Related U.S. Application Data

[63] Continuation-in-part of Ser. No. 167,694, Jul. 11, 1980, abandoned.

[51] Int. Cl.[3] ..... B61L 21/00

[52] U.S. Cl. ..... 246/34 CT; 246/34 B; 246/34 R

[58] Field of Search ..... 246/34 R, 34 CT, 34 B, 246/63 R, 63 A, 63 C, 125, 128, 130, 187 R, 187 B; 455/78, 83; 340/38 L

[56] References Cited

U.S. PATENT DOCUMENTS

| | | | |
|---|---|---|---|
| 3,328,581 | 6/1967 | Staples | 246/34 CT |
| 3,526,378 | 9/1970 | Thorne-Booth | 246/34 CT |
| 3,582,932 | 6/1971 | Chapman | 340/38 L |

*Primary Examiner*—James J. Groody

*Attorney, Agent, or Firm*—Kinzer, Plyer, Dorn & McEachran

[57] ABSTRACT

A railroad signal circuit includes a transmitter and a receiver which have a common connection to the track rails at one end of a signal block. There will be a similar transmitter and receiver at the opposite end of the signal block. A transmit/receive switch is connected in circuit with the transmitter and there is a code following element connecting the receiver to the transmit/receive switch and transmitter. The code following element comprises a Hall effect cell whose output is connected to the receiver.

4 Claims, 1 Drawing Figure

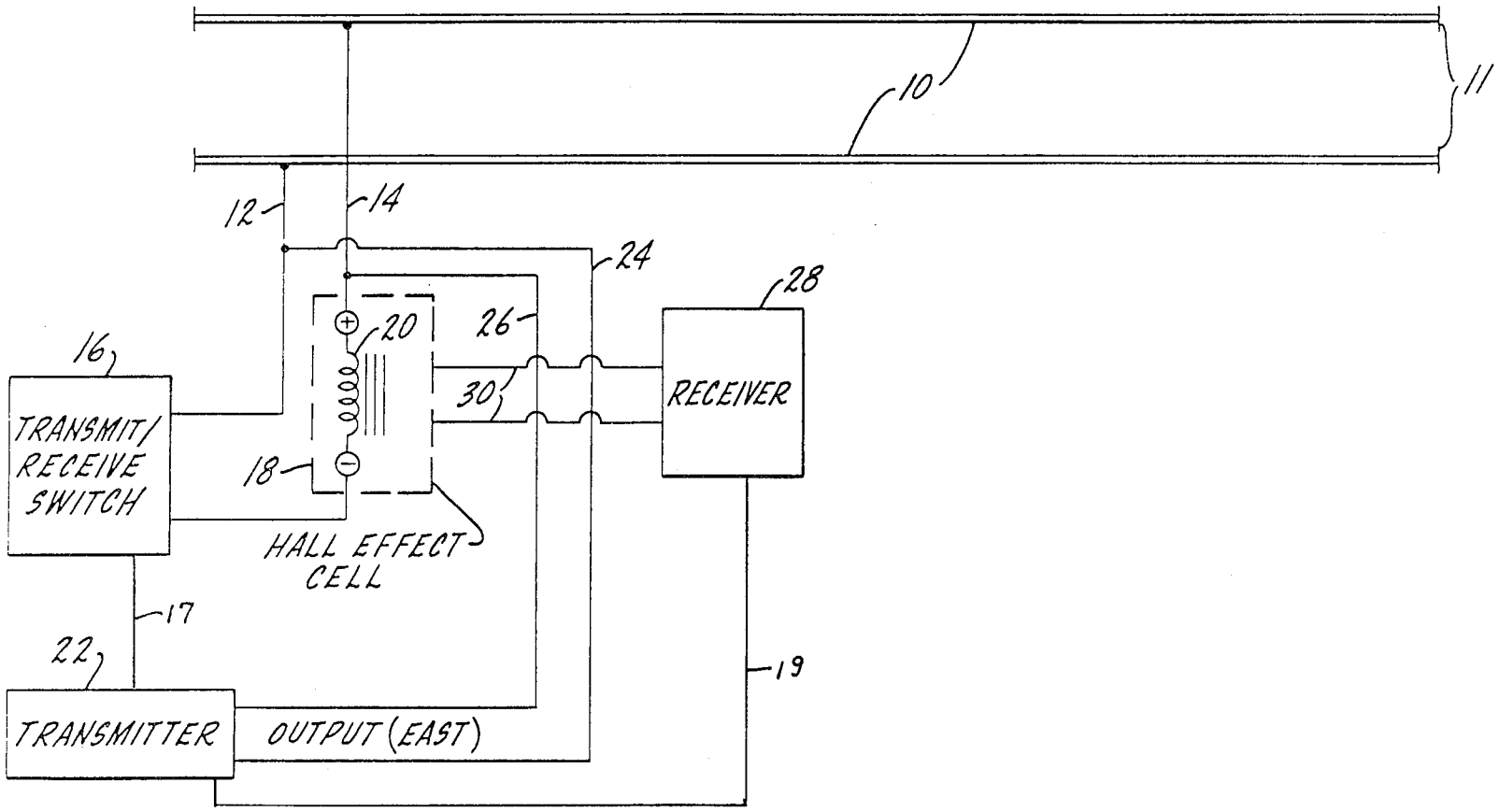
11
10
28
RECEIVER
19
24
26
30
20
HALL EFFECT CELL
14
12
18
OUTPUT (EAST)
16
TRANSMIT/ RECEIVE SWITCH
17
22
TRANSMITTER

HALL EFFECT TRACK CIRCUIT RECEIVING ELEMENT

SUMMARY OF THE INVENTION

This is a continuation-in-part of copending application Ser. No. 167,694, filed July 11, 1980, abandoned.

The present invention relates to railroad signal circuits and in particular to a signal circuit using a Hall effect cell as the code following element.

One purpose is a railroad signal circuit including a transmitter and receiver which have a common connection to the track rails at one end of the signal block and in which the connection between the receiver and transmitter is formed by a code following element in the form of a Hall effect cell.

Another purpose is a signal circuit of the type described utilizing a Hall effect cell which provides substantial economy over previous code following relays in terms of the cost of the code following element and the cost of the ancillary equipment to house the code following element.

Another purpose is a code following element for use in railroad track signal circuits which is substantially smaller and substantially lighter in weight than previous code following relays.

Another purpose is a code following element in the form of a Hall effect cell which eliminates instantaneous open circuits and relay contact bounce, both of which were undesirable characteristics of previous code following relays.

Other purposes will appear in the ensuing specification, drawing and claims.

BRIEF DESCRIPTION OF THE DRAWING

The invention is illustrated in the accompanying diagram illustrating a typical railroad signaling circuit and a Hall effect cell forming the code following element thereof.

DESCRIPTION OF THE PREFERRED EMBODIMENT

Referring to the drawing, typical railroad track rails are indicated at 10 and the space between lines 11 crossing the rails is designated as a signal block. There are wires 12 and 14 connected to rails 10 within the signal block and connected to a typical transmitter and receiver at one end of the block. The opposite end of the signal block will similarly have a transmitter and receiver connected thereto. As indicated in the drawing, the transmitter will direct code signals to the right and the receiver will receive code signals from the left. The opposite would be true at the other end of the block. The particular type of signal code may vary widely and one example is the signal code described in detail in my copending application Ser. No. 021,695, filed Mar. 19, 1979, now U.S. Pat. No. 4,369,942. Normally, the receiver at one end of a signal block will have control over the receiver at the other end of the block so as to control direction of transmission and allocation of message transmission time. This concept is also disclosed in the above-mentioned copending application.

A transmit/receive switch 16 is connected to wires 12 and 14 and is series-connected with a Hall effect cell 18. The Hall cell will include a coil 20 forming a part of an electromagnetic device which is located within the cell. A transmitter 22 is connected by lines 24 and 26 to lines 12 and 14, respectively, and in effect is connected in parallel with switch 16. A receiver 28 receives its input from the Hall effect cell along lines 30. T/R switch 16 is connected by line 17 to transmitter 22 and transmitter 22 is connected by line 19 to receiver 28. The connections between switch 16 transmitter 22 and receiver 28 are the same as shown in my above-mentioned copending application Ser. No. 021,695.

The Hall effect cell may be one of several manufacturers, for example, the Hall effect cell manufactured by Micro Switch, a Division of Honeywell, located in Freeport, Illinois, includes, in addition to the described coil and magnet, a voltage regulator, an amplifier, a Schmitt trigger and an output transistor. The makeup of such Hall cells is well known in the art. The important point herein is the application of such cell in the specific claimed environment.

In operation, when the T/R switch is open, a transmitter 22 provides a particular code signal on rails 10. Because switch 16 is open when the transmitter operates to provide a particular code signal on rails 10, the signal from transmitter 22 cannot be received by receiver 28 as the transmit/receive switch provides an open circuit in the path from the transmitter to the receiver. When switch 16 is closed, the transmitter cannot transmit, but any signal received on wires 12 and 14 from rails 10 will cause an output from the Hall effect code following element 18 to receiver 28. The transmitter is a slave to the receiver and the necessary inhibit signal is carried on line 19. This configuration and the function whereby the receiver controls the transmitter is described in the above-mentioned copending application Ser. No. 021,695. Thus, the Hall effect element replaces the conventional code following relay and has many advantages, as will appear hereinafter.

Previous code following elements were quite large and in fact were known in the railroad art as "gallon" relays because the size of the relay was approximately that of a gallon pail. Such an element is to be contrasted with a Hall effect cell which may have a size of approximately an inch-and-a-half square. The tremendous difference in size, and thus weight, provides an economic differential of aproximately 8 to 1. In addition to the economies in the size and cost of a Hall effect vs. the conventional electromechanical relay, there is the additional advantage of the cabinet which houses the relay. Conventionally, such cabinets are formed of aluminum and the mere size reduction in cabinet from that necessary to house a conventional electromechanical code following relay to a Hall effect element provides economies of approximately several hundred dollars.

A typical electromechanical relay of the type described requires a substantial amount of time for the relay to operate. This is brought about because it takes a period of time for the current through the coil to reach a level sufficient to pull in the relay. The slope of current rise time is quite low and so there is an inherent delay before the induced field is sufficient to operate the relay. In addition, the armature of such a relay is quite heavy, generally a substantial portion of one pound. Accordingly, in addition to the inherent delay because of the inductance of such a large coil, there is the inherent inertia of moving such a large armature. In effect, there is a several millisecond delay following initial receipt of a signal current before the relay actually reaches the point where it is closed.

In a Hall effect device, although there is some small delay due to inductance, it is much less than in the larger electromechanical relay described above. Also, since there is no armature, and since the electronics of the Hall effect cell operate essentially instantaneously, the total effect is a code following element which more closely follows the received signal.

In conventional electromechanical relays there is an instantaneous open circuit between the time when the armature moves off of the back before it reaches a closed position at the front. There are electronic circuits which can compensate for such instantaneous open circuits, but they are expensive and complex. The Hall effect device has no such instantaneous open circuit and so eliminates the necessary ancillary or auxiliary circuits formerly required to compensate for the instantaneous open. In effect, the Hall effect cell provides a switch closure or a switch closed signal a minute period of time after the application of current from the track rails.

Another disadvantage of electromechanical relays is contact bounce upon closure. This is brought about by the size of the armature. In a Hall effect cell, since there is no armature, there will be no contact bounce and thus the device will provide no momentary open circuit. There is an essentially instantaneous electronic switch closure in the Hall effect device when the proper signal level has been provided at the coil of the device.

Since the Hall effect device is substantially quicker or faster in operation when compared to an electromechanical relay, it is possible to include more signal information in a given time period. In most communication systems the limitation is not the transmission medium, but, rather, the relays which are processing the data. Using a code following element as disclosed herein, since it is essentially instantaneous in operation, it is possible to include a great deal more data in a given time period. This in itself permits the operators to build in greater security and more signal aspects than were heretofore possible.

Because of the small size of the code following element disclosed herein, it is possible to include such element in a prewired assembly. This permits economies in installation and also provides a basis for greater lightning protection for the code following element, something that had not been heretofore possible since the former gallon-size electromechanical relays of necessity had to be separately wired and located outside of any prewired enclosure.

Whereas the preferred form of the invention has been shown and described herein, it should be realized that there maybe many modifications, substitutions and alterations thereto.

The embodiments of the invention in which an exclusive property or privilege is claimed are defined as follows:

1. A railroad signal circuit including a transmitter and receiver having a common connection to the track rails at one end of a signal block, a transmit/receive switch connected to said transmitter and a code following element connected to said receiver and connected to said transmit/receive switch and transmitter, said code following element comprising a Hall effect cell whose output is connected to said receiver, said transmit/-receive switch preventing signals from said transmitter being received by said receiver.

2. The signal circuit of claim 1 further characterized in that said transmit/receive switch is connected in parallel with said transmitter.

3. The railroad signal circuit of claim 1 further characterized in that said Hall effect cell has a coil, which coil is in series connection with said transmit/receive switch.

4. The railroad signal circuit of claim 1 further characterized by and including a second transmitter and a second receiver having a common connection to the track rails at the other end of a signal block, said second transmitter and second receiver having a second transmit/receive switch connected to said second transmitter and a second code following element connected to said second receiver and connected to said second transmit/receive switch and second transmitter, said second code following element comprising a Hall effect cell whose output is connected to said second receiver, said second transmit/receive switch preventing signals from said second transmitter being received by said second receiver.

* * * * *